US011136823B1

(12) United States Patent
Canfield et al.

(10) Patent No.: US 11,136,823 B1
(45) Date of Patent: Oct. 5, 2021

(54) LADDER FALL PROTECTION SYSTEM AND FALL ARRESTER

(71) Applicant: Buckingham Manufacturing Company, Inc., Binghamton, NY (US)

(72) Inventors: DeForest C. Canfield, Oxford, NY (US); James J. Rullo, Binghamton, NY (US); Kevin W. Truesdell, Binghamton, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 265 days.

(21) Appl. No.: 15/722,892

(22) Filed: Oct. 2, 2017

Related U.S. Application Data

(63) Continuation of application No. 14/676,220, filed on Apr. 1, 2015, now abandoned.

(60) Provisional application No. 61/973,673, filed on Apr. 1, 2014.

(51) Int. Cl.
*E06C 7/18* (2006.01)
*A62B 1/16* (2006.01)

(52) U.S. Cl.
CPC ..... *E06C 7/186* (2013.01)

(58) Field of Classification Search
CPC .. A62B 1/14; A62B 1/06; A62B 27/00; A62B 35/0081; A62B 35/0043; A62B 35/005; A62B 35/0068; A62B 35/0075; A62B 1/16; E06C 7/187; E06C 7/186
USPC ..... 182/8
See application file for complete search history.

(56) References Cited

U.S. PATENT DOCUMENTS

| | | | | | |
|---|---|---|---|---|---|
| 4,059,871 | A * | 11/1977 | Swager | A62B 1/14 | 24/134 R |
| 4,130,177 | A * | 12/1978 | Pandolph | E06C 7/187 | 182/133 |
| RE30,072 | E * | 8/1979 | Kleine | E06C 7/186 | 182/5 |
| 4,193,475 | A * | 3/1980 | Sweet | A62B 35/0062 | 182/8 |
| 4,423,796 | A * | 1/1984 | Sulowski | E04G 21/3261 | 182/8 |
| 5,316,103 | A * | 5/1994 | Bell | A62B 35/005 | 182/18 |
| 5,934,408 | A * | 8/1999 | Flux | A62B 35/04 | 182/192 |
| 8,887,866 | B2 * | 11/2014 | Petty | A63B 27/00 | 182/9 |
| 9,132,297 | B2 * | 9/2015 | Casebolt | A62B 1/14 | |
| 9,168,402 | B2 * | 10/2015 | Casebolt | A62B 35/0081 | |
| 9,517,362 | B1 * | 12/2016 | Siegel | A62B 1/14 | |
| 9,744,383 | B2 * | 8/2017 | Antonio | A62B 1/20 | |
| 2003/0051944 | A1 * | 3/2003 | Shea | A62B 1/14 | 182/193 |

(Continued)

FOREIGN PATENT DOCUMENTS

WO WO-2009149527 A2 * 12/2009 ..... A62B 1/16

*Primary Examiner* — Daniel P Cahn
(74) *Attorney, Agent, or Firm* — Bond Schoeneck & King, PLLC; Frederick Price; George McGuire

(57) ABSTRACT

A fall arrest system for use on a ladder. The fall arrest system includes a primary rope line on which a fall arrester is slidably mounted, and a pair of anchor assemblies that securely extend and connect between the primary rope line and respective legs of the ladder. A body harness worn by a worker climbing the ladder is tethered to the fall arrester.

4 Claims, 13 Drawing Sheets

(56) References Cited

U.S. PATENT DOCUMENTS

| | | | | |
|---|---|---|---|---|
| 2005/0284703 | A1* | 12/2005 | Deuer | E06C 7/186<br>182/206 |
| 2007/0256892 | A1* | 11/2007 | Breedlove, Sr. | A01M 31/02<br>182/116 |
| 2009/0235425 | A1* | 9/2009 | Walker | A62B 1/16<br>2/69 |
| 2010/0038172 | A1* | 2/2010 | Ralston | E06C 7/46<br>182/107 |
| 2010/0199472 | A1* | 8/2010 | Millar | A62B 1/16<br>24/599.1 |
| 2013/0233648 | A1* | 9/2013 | Smit | A62B 35/0093<br>182/241 |
| 2014/0090927 | A1* | 4/2014 | Patton | A62B 35/0068<br>182/112 |
| 2016/0047167 | A1* | 2/2016 | Shuch | E06C 7/186<br>182/8 |
| 2016/0114199 | A1* | 4/2016 | Bogardus, Jr. | A62B 35/0043<br>182/3 |
| 2016/0176683 | A1* | 6/2016 | Huehn | B66C 1/16<br>294/74 |
| 2017/0246508 | A1* | 8/2017 | Bonnet | A63B 29/02 |
| 2020/0080377 | A1* | 3/2020 | Simon | E06C 7/18 |

* cited by examiner

LADDER FALL PROTECTION SYSTEM AND FALL ARRESTER

REFERENCE TO RELATED APPLICATION

The present application relates and claims priority to U.S. Non-Provisional application Ser. No. 14/676,220, filed on Apr. 1, 2015, and Provisional Patent Application Ser. No. 61/973,673, filed on Apr. 1, 2014, the entirety of each is hereby incorporated by reference.

BACKGROUND OF THE INVENTION

The present invention relates to systems for arresting the fall of someone or something from a ladder.

Arborists and utility linemen, among others, must climb ladders to significant heights while carrying substantial tools and carrying out repair, maintenance, and installation tasks that necessitate significant movement. The movement coupled with the great weight of the tools and equipment place the workers in precarious and dangerous situations. If balance is lost or a foot slips on a rung, for example, the worker might fall off the ladder resulting in injury and perhaps even death.

To minimize the risk of injury, various fall arresters have been developed. In a common arrangement a fall arrester is mounted on a primary line that hangs from a rung of the ladder. The fall arrester is tethered to a worker's body harness. If the work slips of falls from a rung on the ladder, the fall arrester engages the primary rope line and prevents the worker from falling. However, on an object such as a ladder, the primary rope line can be inadvertently moved to one end of the rung or another causing an unbalanced load to be imparted to the ladder in the event the worker slips or falls. Moreover, as the rung of the ladder is the only point of anchoring the system the load caused by the sudden slipping or falling of a worker might cause the rung to break, thereby rendering the arrest system useless.

It is therefore an object and advantage of the present invention to provide a secure system for arresting the fall of a person or object from a ladder.

It is another object and advantage of the present invention to provide a secure system for arresting the fall of a worker from a ladder that more evenly distributes the load realized by the ladder.

It is a further object and advantage of the present invention to provide a secure system for arresting the fall of a worker from a ladder that anchors to the areas of a rung adjacent the legs of the ladder.

SUMMARY OF THE INVENTION

In accordance with the foregoing objects and advantages, the present invention provides a fall arrest system for use on a ladder having first and second ladder legs and a plurality of parallel, spaced rungs that extend transversely between the first and second ladder legs, the fall arrest system comprising: a primary line having a looped end; a fall arrester slidably mounted on the primary line; first and second connectors each attached to the primary line at the looped end; first and second anchor assemblies adapted for extension between the first and second legs of the ladder, respectively, and the first and second connectors, respectively.

In one aspect of the invention, the fall arrester for use in combination with the fall arrest system that includes a primary line, includes: front and rear cover plates held in spaced parallel relation to one another; a mounting block and a guide block each sandwiched between the front and rear cover plates and defining a rope passage between them; and a rope grabbing element pivotally mounted to the interior surface of the rear cover plate and pivotally movable between a neutral position that permits the primary line to freely pass through rope passage, and a rope cinching position that pinches the primary line between the mounting block and its end and prevents the primary line from moving.

In another aspect of the invention, the fall arrest system is provided in a kit for use by utility lineman and similar workers. The kit includes a bag; a primary line having a looped end; a fall arrester adapted for mounting on said primary line; first and second connectors each adapted for attachment to said primary line at said looped end; and first and second anchor assemblies each adapted for extension between the first and second legs of the ladder, respectively, and the first and second connectors, respectively.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
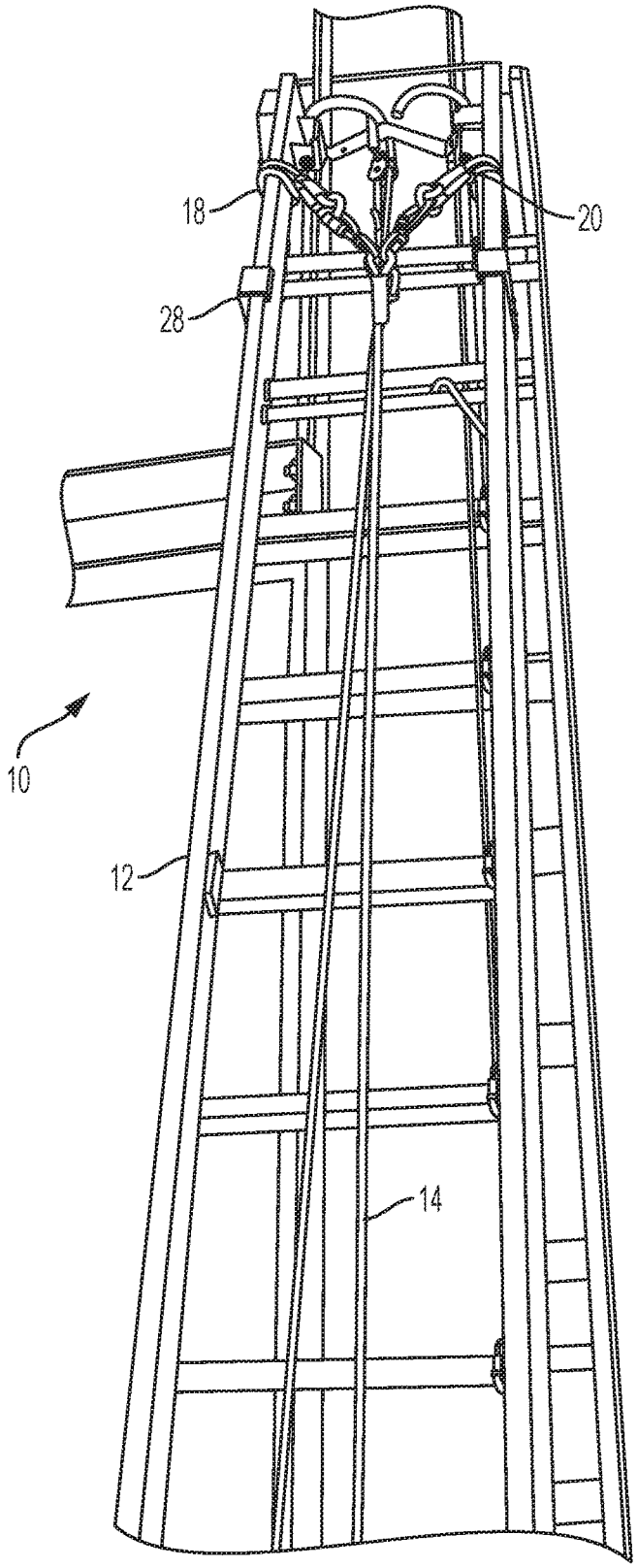
FIG. 1 is a perspective view of a ladder equipped with a fall arresting system in accordance with an embodiment of the present invention.
Figure 2A:
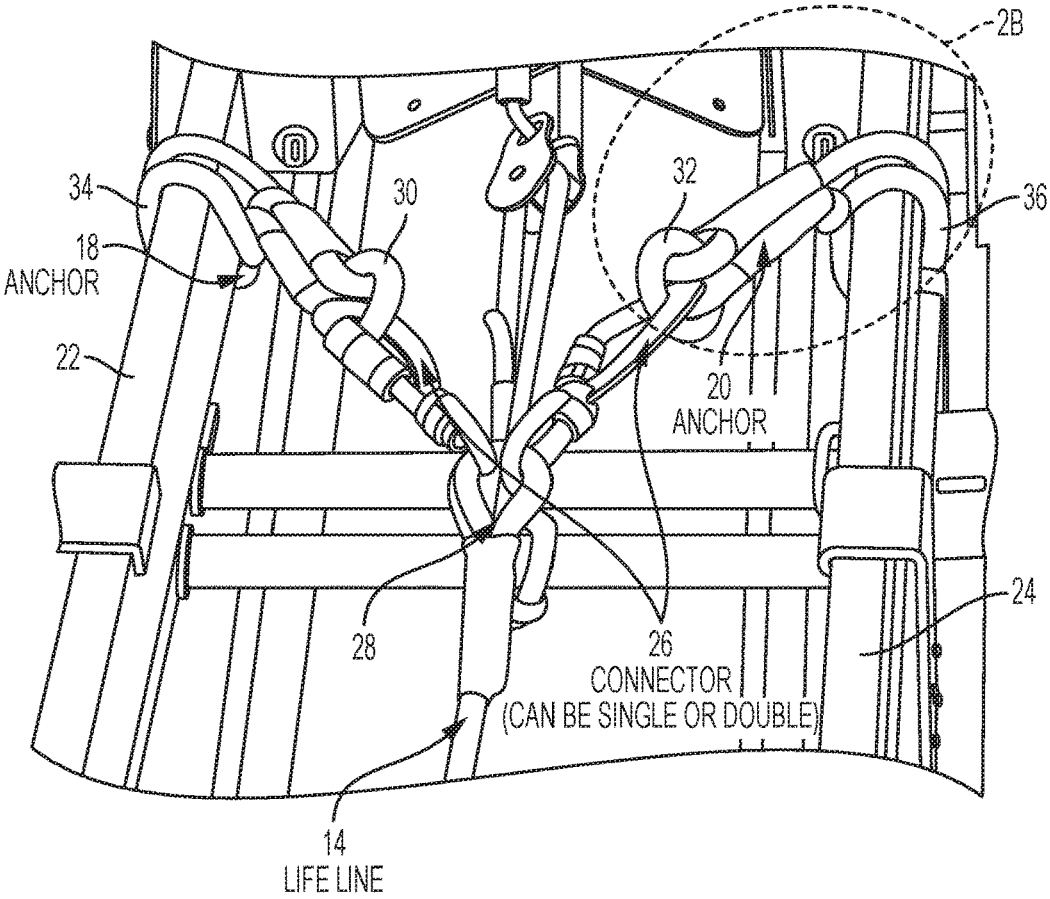
FIG. 2A is a perspective view of an anchor assembly.
Figure 2B:
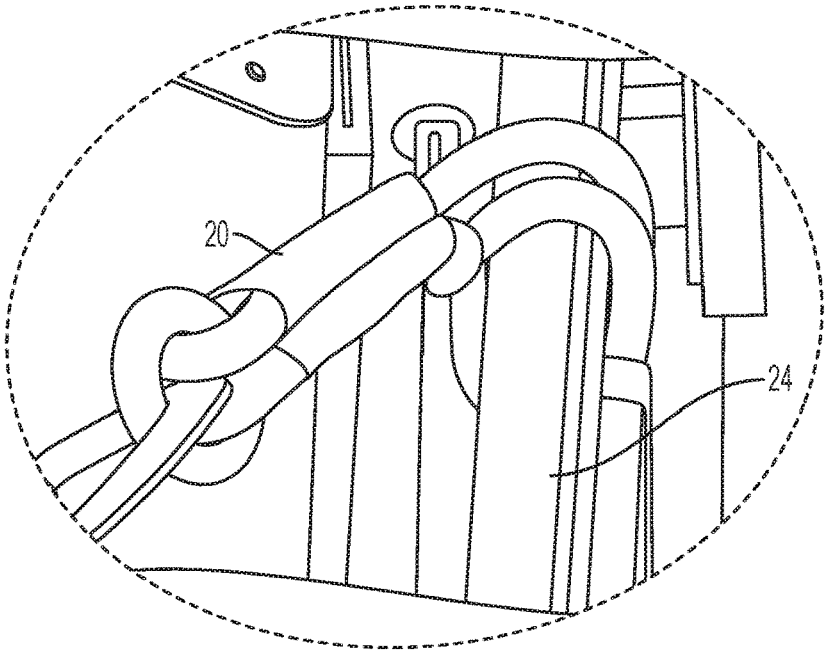
FIG. 2B is the encircled portion of FIG. 2A labelled 2B.
Figure 3:
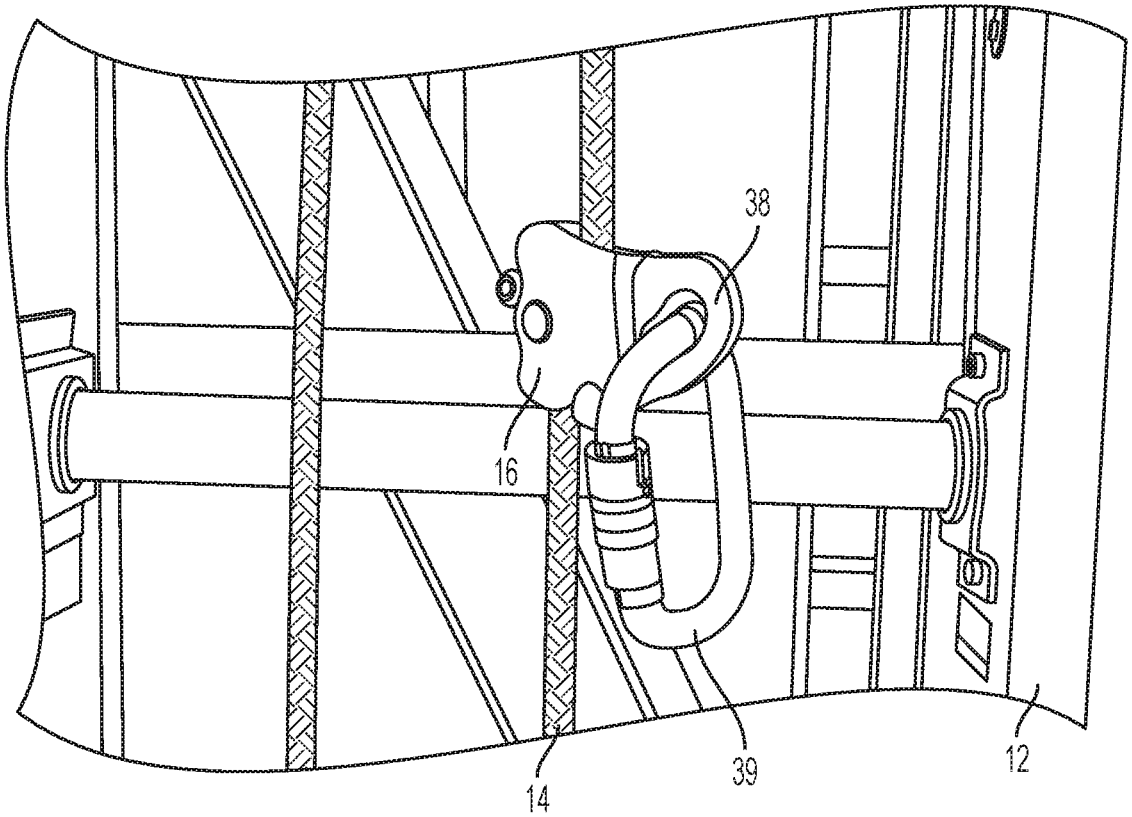
FIG. 3 is a close-up perspective view of the fall arrester mounted to a primary line.
Figure 4:
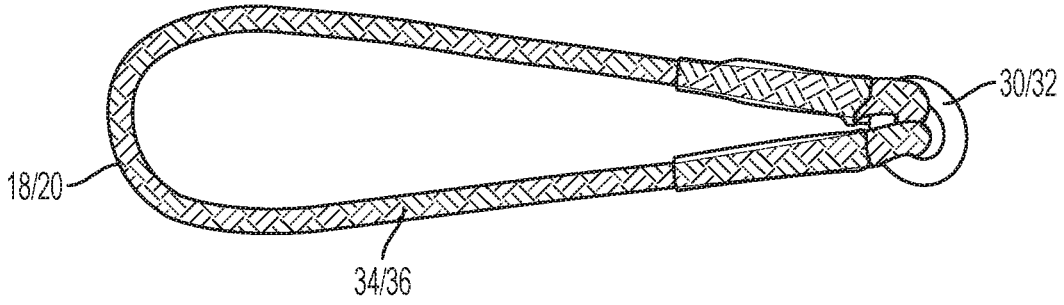
FIG. 4 is a plan view of one embodiment of an anchor.

Referring now to the drawings, wherein like reference numerals refer to like parts throughout, there is seen in FIG. 1 a ladder fall protection system, designated generally by reference numeral 10, that is installed on a ladder 12. In one embodiment shown in FIG. 1, fall protection system 10 generally comprises a primary rope line 14 on which a conventional fall arrester 16 is mounted. System 10 further comprises a pair of anchor systems 18, 20 that connect between the top end of primary rope line 14 and one of the ladder legs 22, 24, respectively, as further described hereinafter.

More specifically, each of the anchor systems 18, 20 comprise a connector 26, such as a carabineer or similar type of connector (note that two connectors can be used for additional strength if desired), that connects through a loop 28 that forms the top end of primary rope line 14 and to rings 30, 32 that are part of anchor assemblies 18, 20, respectively. An anchor rope 34, 36, is connected to rings 30, 32, respectively, and each rope 34, 36 is looped around ladder leg 22, 24, respectively, thereby forming a secure anchorage between primary rope line 14 and ladder 12.

Figure 9:
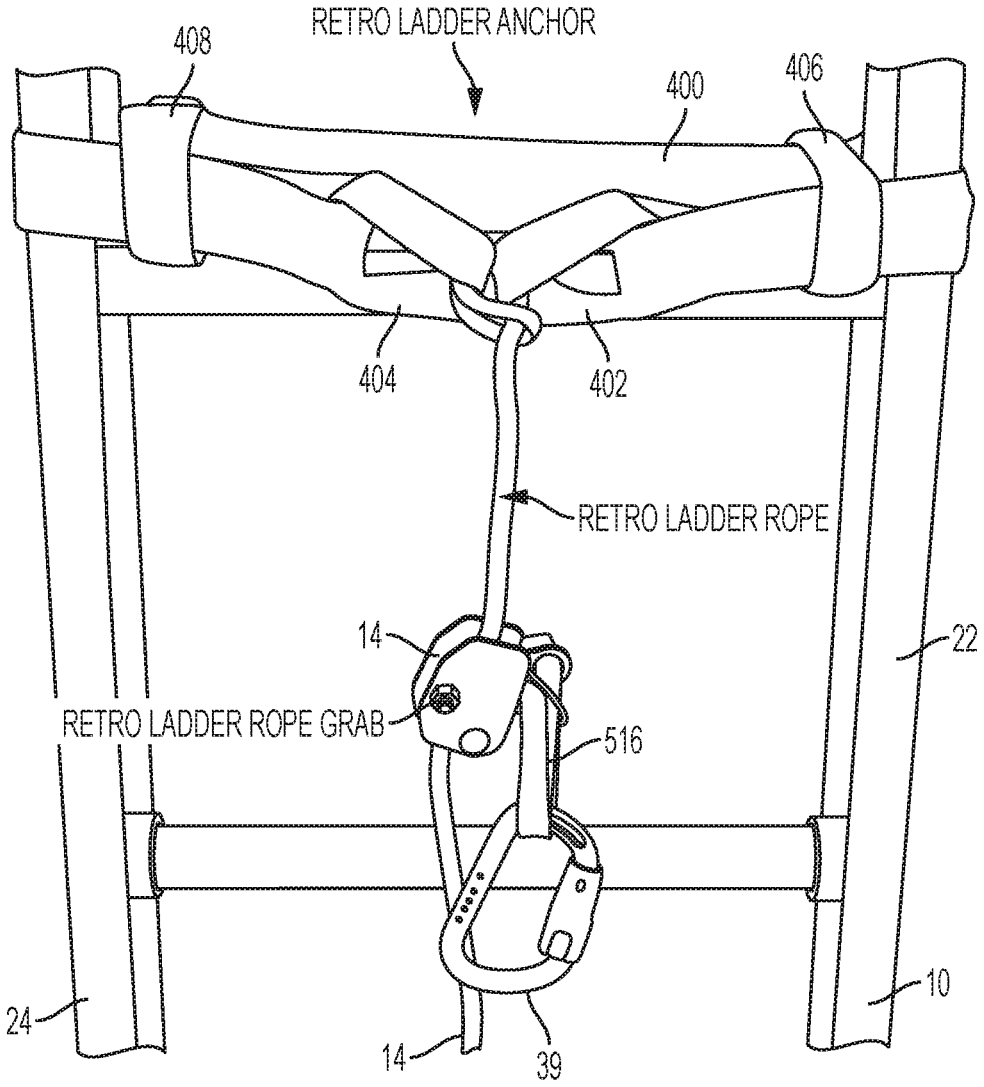
FIG. 9 is a partial perspective view of an alternate embodiment of a ladder fall protection system.
Figure 10:
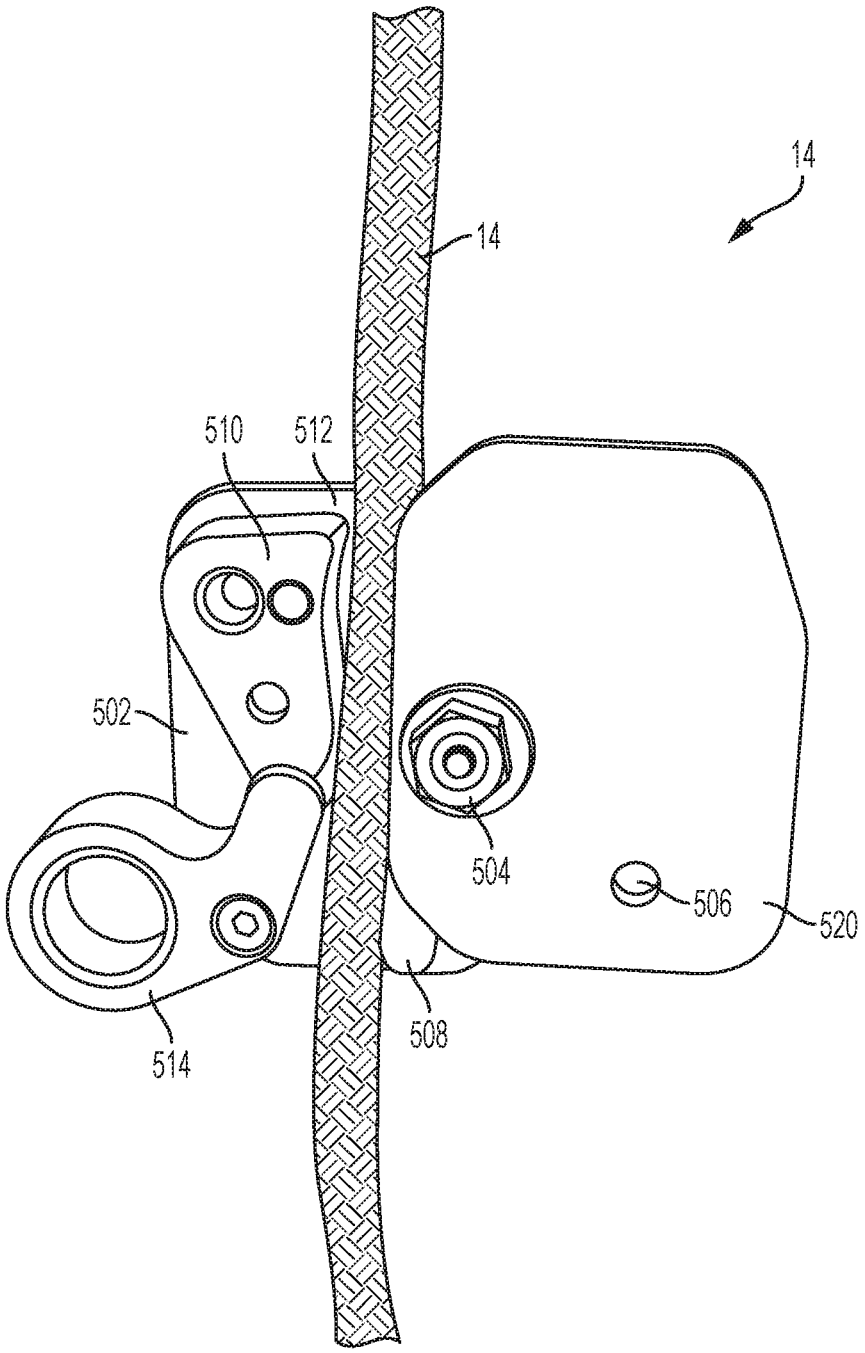
FIG. 10 is a perspective view of a fall arrester in its open position used in conjunction with the present invention.
Figure 11:
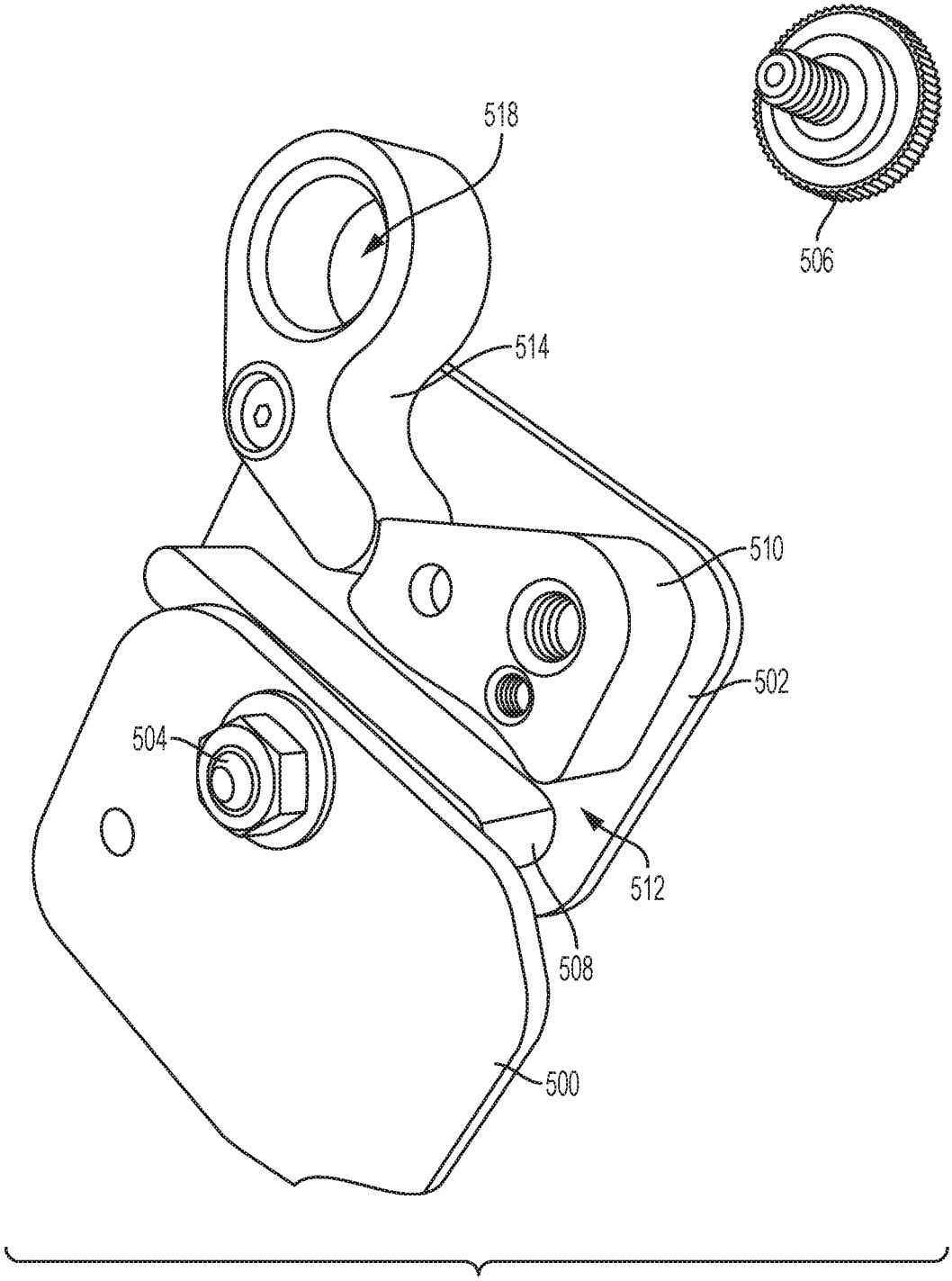
FIG. 11 is a second perspective view a fall arrester in its open position used in conjunction with the present invention.
Figure 12:
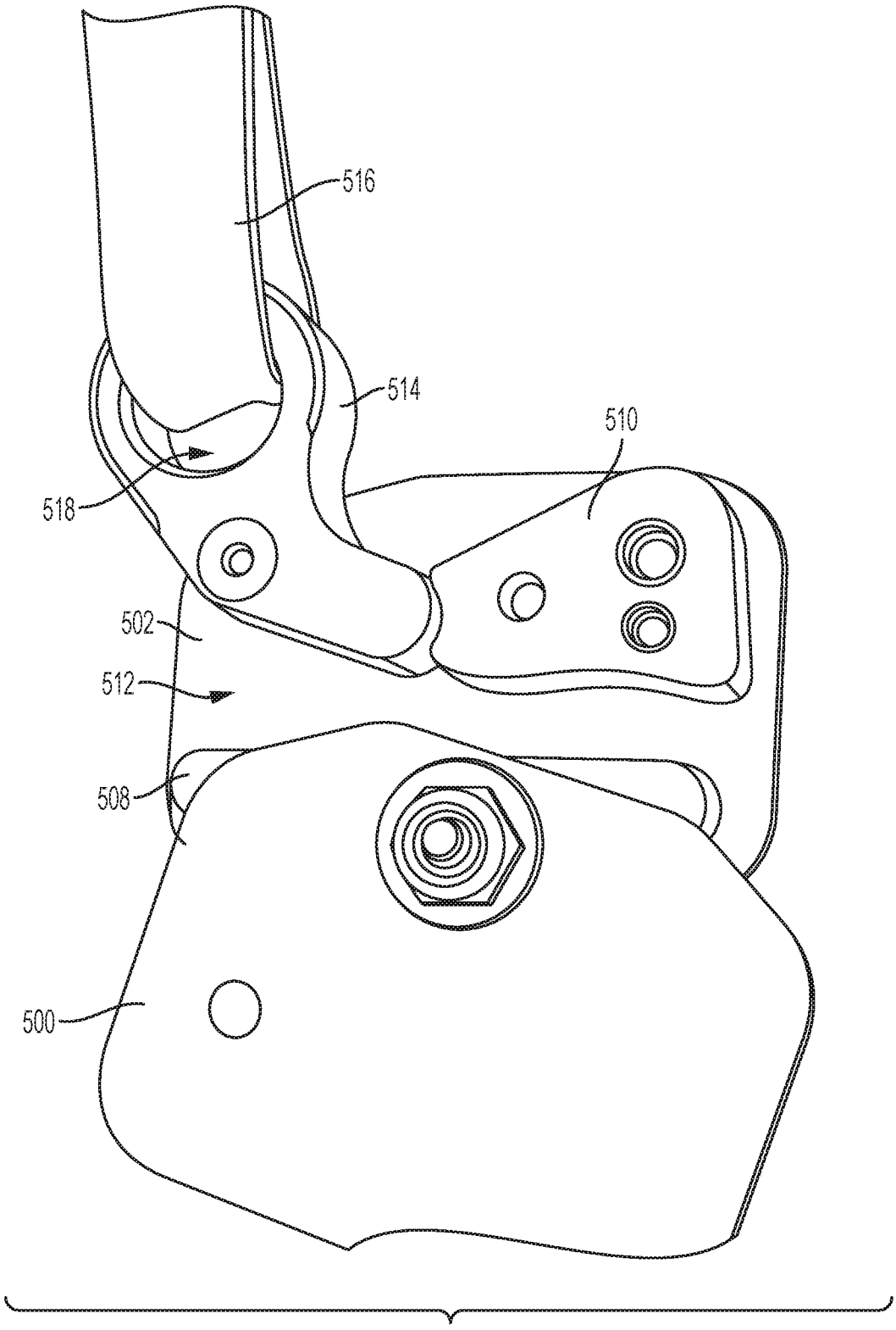
FIG. 12 is a second perspective view a fall arrester in its open position used in conjunction with the present invention.
Figure 13:
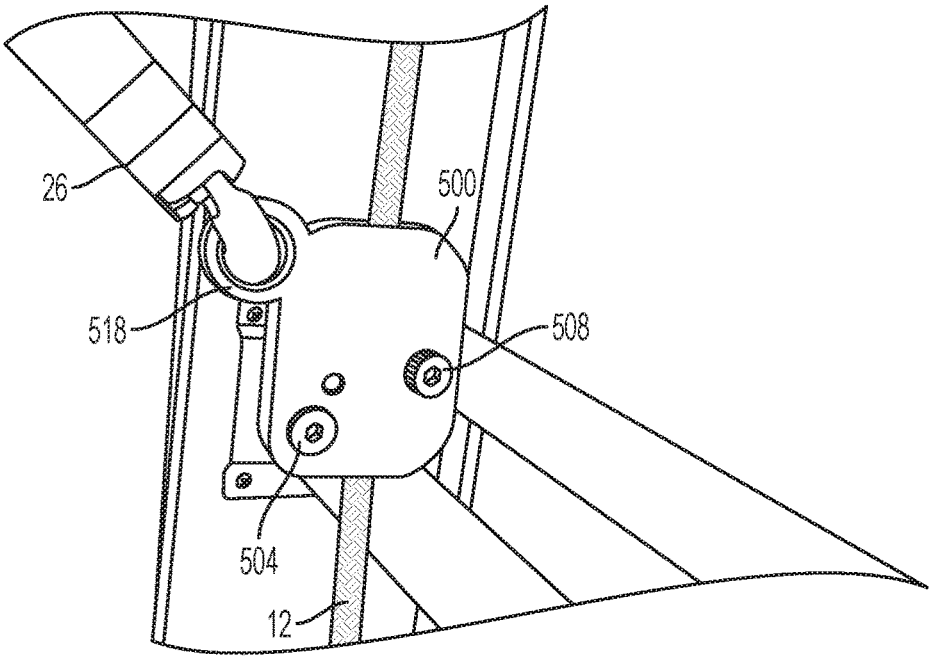
FIG. 13 and FIG. 14 are both partial perspective views of the fall arrester in use with a ladder.
Figure 14:
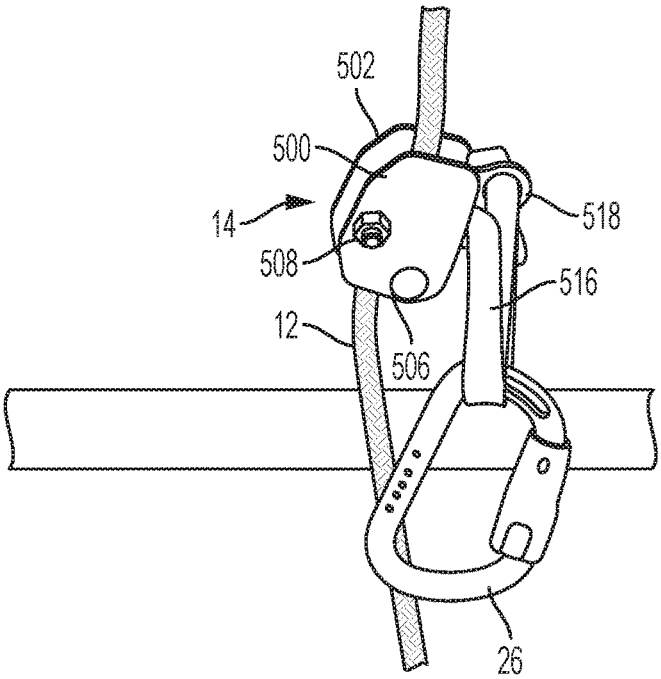
Figure 15:
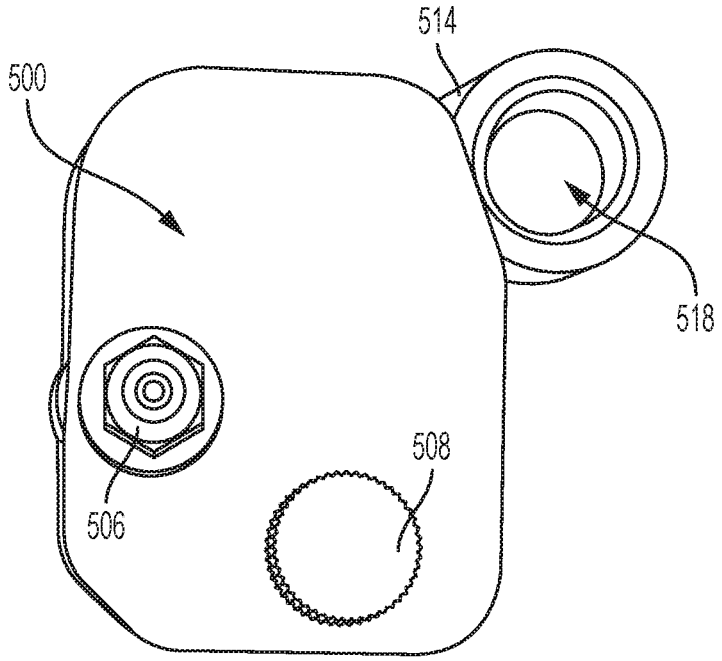
FIG. 15 is a perspective view of the fall arrester in its closed position.
Figure 16:
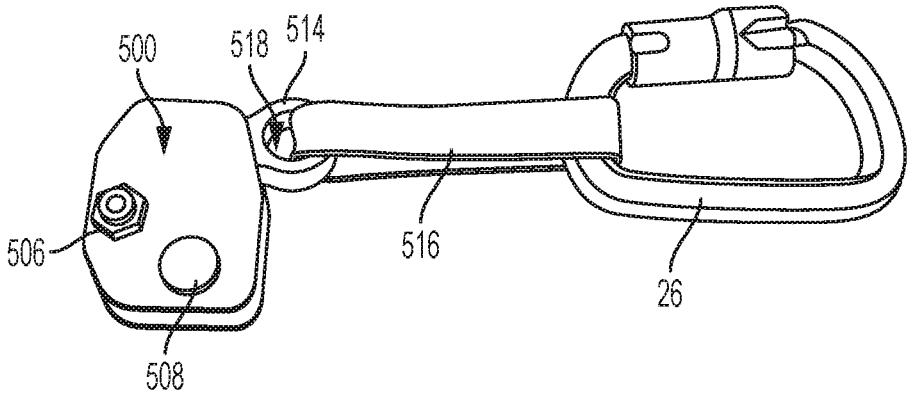
FIG. 16 is a perspective view of the fall arrester in its closed position and with the harness connecter attached thereto.
Figure 17:
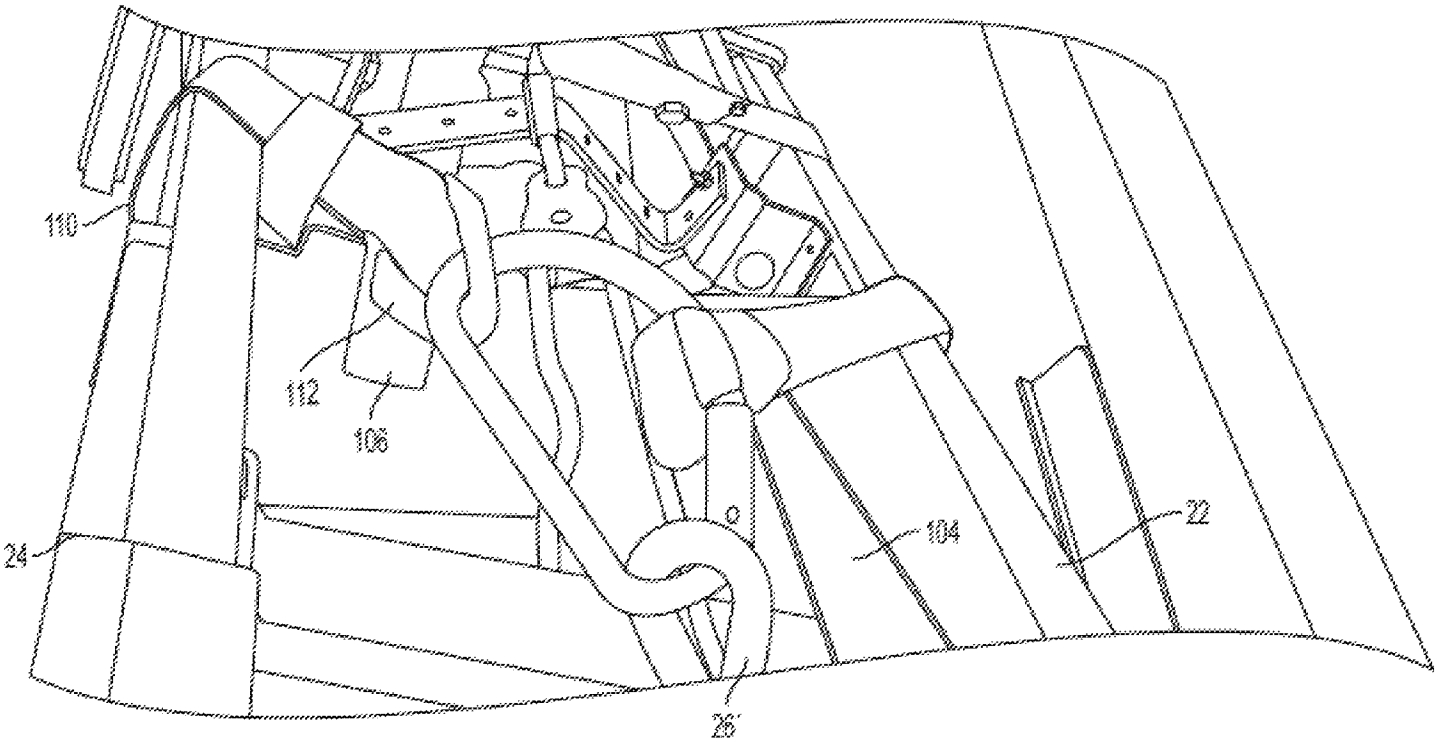
FIG. 17 is a close-up perspective view of an alternative embodiment of an anchor assembly with a single connector.

As a worker is climbing ladder 12, s/he would attach the connector portion 38 of fall arrester 16 to a body harness 30 by a connector (e.g., carabineer) 39 (see FIG. 9). While climbing up the ladder, the worker can slide the fall arrester 16 up the primary rope line 14 such that it is always positioned at about the same height as the worker. If the worker was to slip or fall off ladder 12, fall arrester 16 would immediately engage primary rope line 14 suspending the worker and preventing him/her from falling to the ground. In addition, the anchor systems 16, 18 will slide on the legs 22, 24 and engage a rung of the ladder in the area adjacent the legs 24, 26 which provides a far stronger suspension anchor than when situated at a mid-point along a rung (which would produce both a moment and subject the rung to a greater load at a point where the rung is far weaker than at its ends), thereby adding to the security offered by the system.

Figure 5:
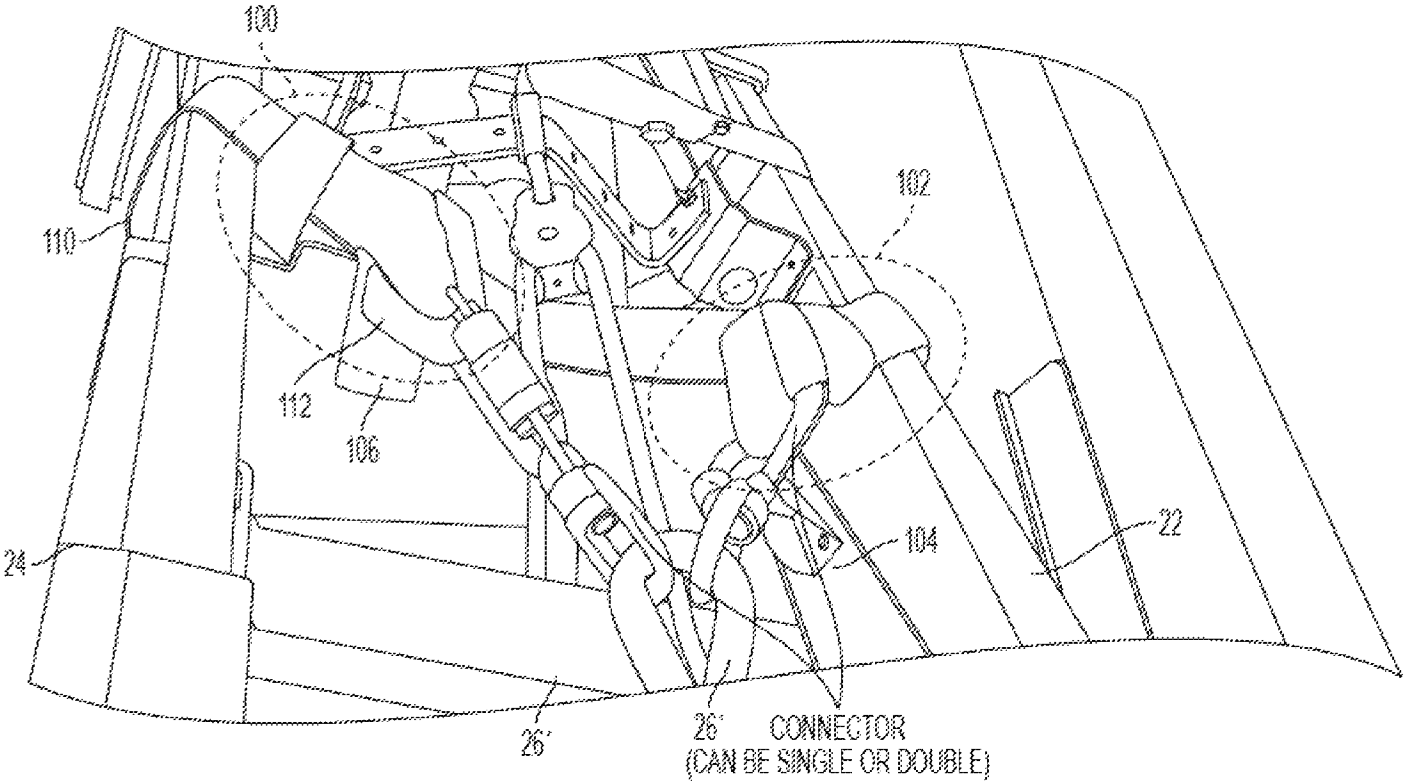
FIG. 5 and FIG. 6 are close-up perspective views of an alternate embodiment of an anchor assembly.
Figure 6:
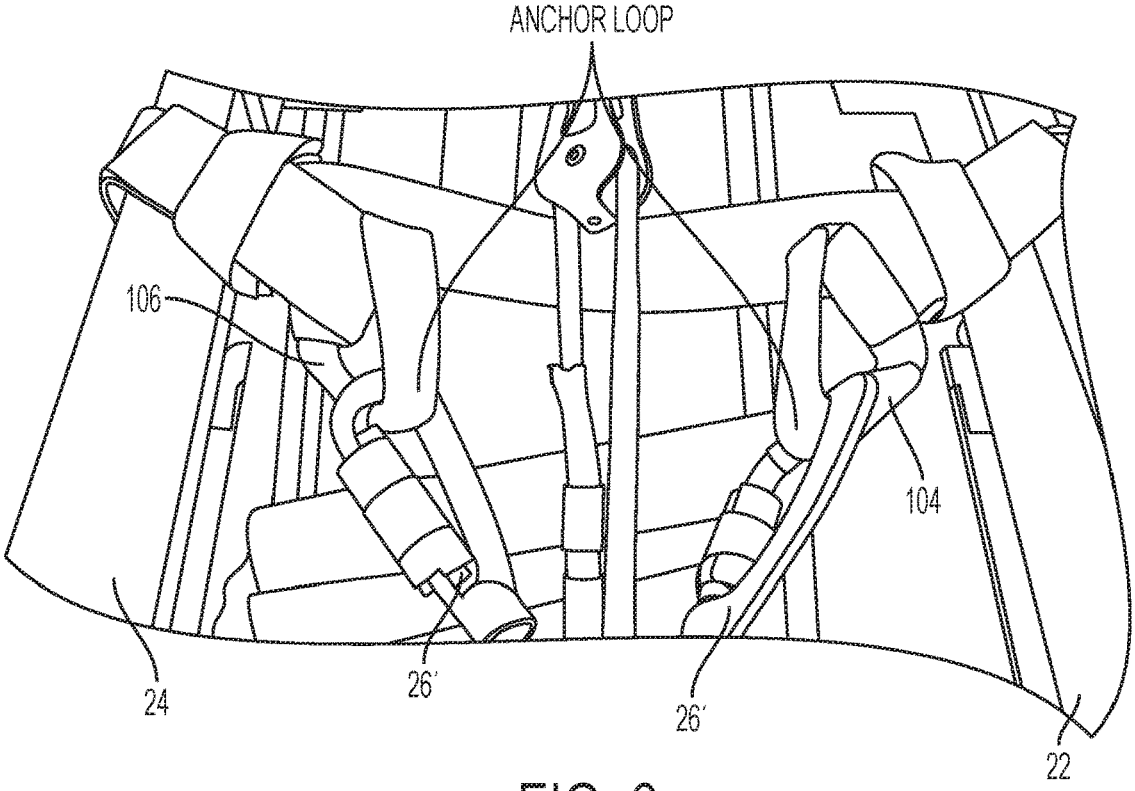
Figure 7:
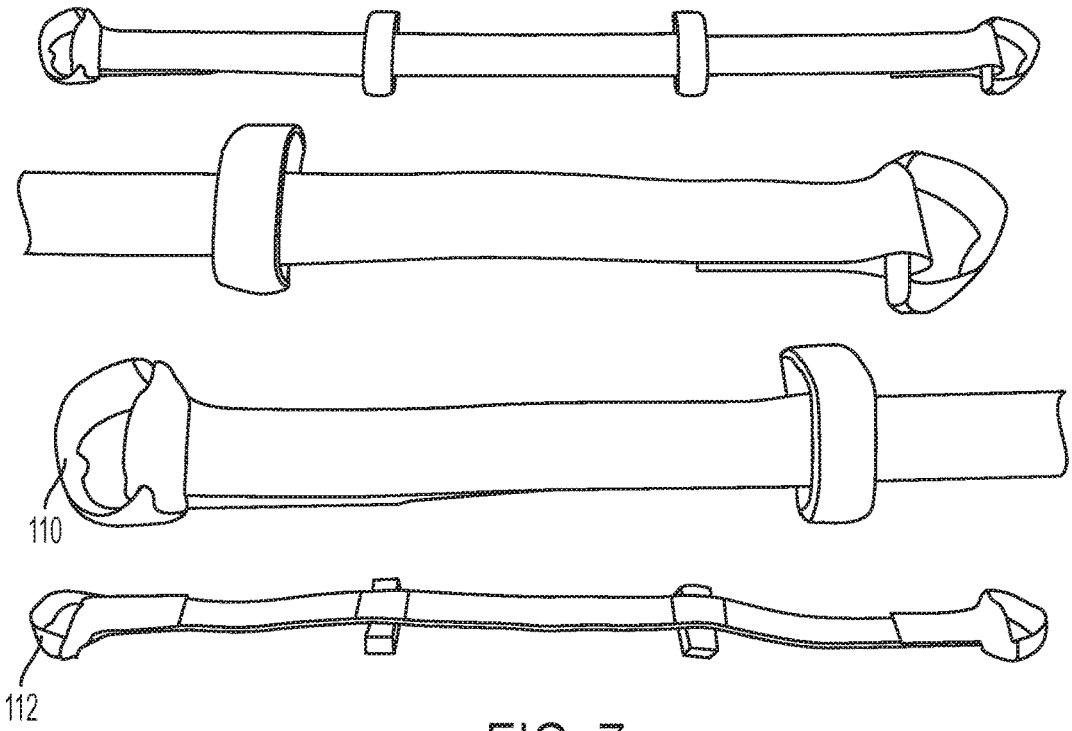
FIG. 7 is a plan view of the anchor assembly in the alternate embodiment.

In an alternate embodiment of system 10, shown in FIGS. 5-7, anchor systems 100, 102 each comprise lengths of webbing material instead of rope as with anchor systems 18, 20. Each anchor system 100, 102 comprise an anchor loop 104, 106 that is formed at one end of an anchor web 108 and that connects to connector 26'. A strip of anchor webbing 110 extends between anchor loops 104, 106 and a second anchor webbing strip 112 is laced with anchor webbing 110 and secures an anchorage around the legs 22, 24 of ladder 12.

The addition of the anchorage assembly to the fall arrest system provides added security by providing a solid anchorage for the primary rope line 14 on what is otherwise a relatively unstable mounting, namely the ladder. The anchors provide symmetry to the system and split the load carried by the primary rope line 14 and fall arrester 16.

Figure 8:
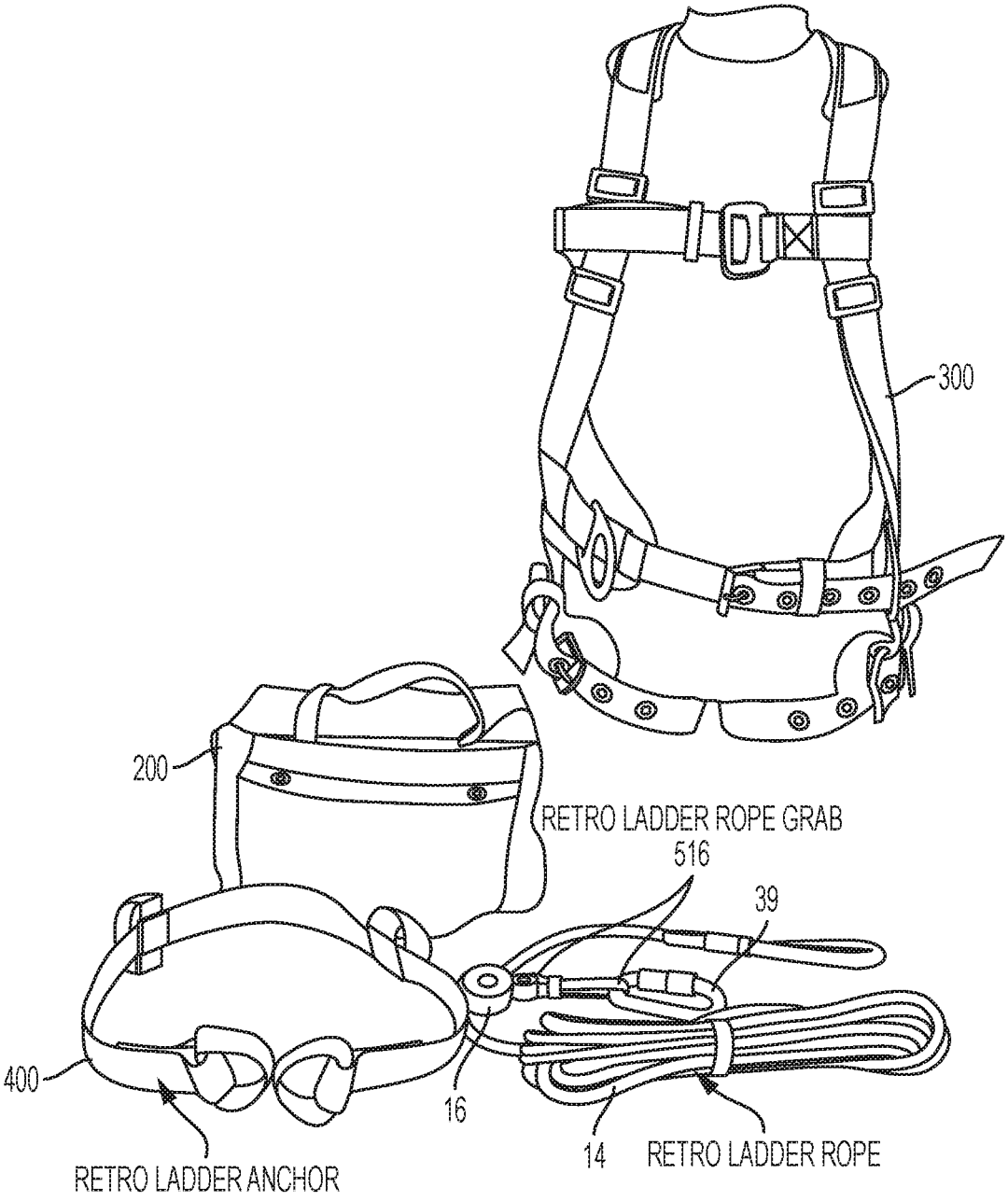
FIG. 8 is a perspective view of a kit for a ladder fall protection system.

With reference to FIG. 8, system 10 may be provided in a kit that includes a bag 200 in which primary rope 14, fall arrester 16, connector 26 (with attachment anchor assembly) are all contained, and a body harness 300 to be worn by the user who can tether himself to system 10.

With reference to FIG. 9, a ladder anchor 400 comprises a length of webbing having a pair of loops 420, 404 attached at its opposite ends, and a pair of loops 406, 408 attached at intermediate positions along its length. Anchor 400 wraps around ladder legs 22, 24 and the looped ends 402, 404 pass through intermediate loops 406, 408, respectively. The end of primary rope 14 may then be tied off through looped ends 402, 404, thereby securely interconnecting them and forming a secure attachment to ladder 12. Primary rope 14 extends through ladder arrester 16 and a connector 26 may be used to connect body harness 300 (shown in FIG. 8) to the ladder arrest anchor 400.

With reference to FIGS. 10-16, details of the fall arrester 16 are provided. Fall arrester 16 comprises front and rear cover plates 500, 502, held in spaced, parallel planes to one another by nut and bolt 504 (it should be noted that a rivet or other conventional fastener could be used in place of a nut and bolt) and bolt 506. Sandwiched between plates 500, 502 are a mounting block 508 that extends along one edge of the plates and serves in part to maintain the spacing and stability of plates 500 and 502, a guide block 510 that is secured to the inwardly facing surface of plate 502 and together with mounting block 508 defines the passageway 512 through which primary rope 12 will extend, and a rope grabbing element 514 pivotally mounted to the interior surface of plate 502 and pivotally movable between a neutral position that permits rope 12 to freely pass through passageway 512, and a rope cinching position that pinches rope 12 between mounting block 508 and its end and prevents rope 12 from moving.

A sufficient force must be applied to move rope grabbing element 514 from its neutral position to its rope cinching (it should be noted that a spring, not shown, could be used to maintain a bias towards the neutral position and then this spring force would need to be overcome; however, a spring is not absolutely necessary for operation of the grab). This force is supplied by the user when he/she falls/slips from ladder 12. A short length of rope 516 interconnects connector 39 (which in turn is connected to body harness 300) to rope grabbing element 514 (at an opening 518 formed through rope grabbing element 514 at an area that is external to plates 500, 502). If and when a user falls/slips from ladder 12, rope 516 will pull and cause rope grabbing element 514 to pivot to its rope cinching position, thereby arresting the fall of the user.

What is claimed is:

1. A fall arrest system for use on a ladder having first and second ladder legs and a plurality of parallel, spaced rungs that extend transversely between the first and second ladder legs, the fall arrest system comprising:

a) a primary line having a looped end;

b) a fall arrester slidably mounted on said primary line;

c) either a connector attached to said primary line at said looped end or a first connector and a second connector attached to said primary line at said looped end;

d) a length of webbing adapted for extension between the first and second legs of the ladder;

e) a first anchor loop being formed at a first end of the length of webbing;

f) a second anchor loop being formed at a second end of the length of webbing, the first end and the second end forming opposing ends of the length of webbing, wherein either (1) the first anchor loop and the second anchor loop are each directly attached to the connector, or (2) the first anchor loop is directly attached to the first connector and the second anchor loop is adapted to attach to the second connector; and g) a first loop and a second loop each formed at a respective intermediate position along the length of webbing.

2. The fall arrest system of claim 1, wherein said fall arrester comprises front and rear cover plates held in spaced parallel relation to one another, a mounting block and a guide block each sandwiched between said front and rear cover plates and defining a rope passage between them, and a rope grabbing element pivotally mounted to an interior surface of said rear cover plate and pivotally movable between a neutral position that permits said primary line to freely pass through the rope passage, and a rope cinching position that pinches said primary line between said mounting block and an end of the rope grabbing element and prevents the fall arrester from moving with respect to the primary line.

3. The fall arrest system of claim 2, wherein said rope grabbing element further comprises an extension that is externally positioned relative to said front and rear cover plates and that includes means for connecting said rope grabbing element to a force generating body.

4. The fall arrest system of claim 1, wherein the second anchor loop is directly attached to the second connector.

* * * * *